United States Patent [19]

Szostak et al.

[11] 4,411,209

[45] Oct. 25, 1983

[54] CAM SELECTOR MECHANISM FOR SEWING MACHINES

[75] Inventors: Jan Szostak, Lincroft; Henry Schaeflern, Pittstown, both of N.J.

[73] Assignee: The Singer Company, Stamford, Conn.

[21] Appl. No.: 395,527

[22] Filed: Jul. 6, 1982

[51] Int. Cl.[3] ..... D05B 3/02

[52] U.S. Cl. ..... 112/158 A

[58] Field of Search ..... 112/158 D, 158 A, 158 R

[56] References Cited

U.S. PATENT DOCUMENTS 3,699,910 10/1972 Uriciola et al. ..... 112/158 A 3,753,411 8/1973 Graham et al. ..... 112/210

*Primary Examiner*—Werner H. Schroeder

*Assistant Examiner*—Andrew M. Falik

*Attorney, Agent, or Firm*—Robert E. Smith; Edward L. Bell

[57] ABSTRACT

A pattern cam selector mechanism for sewing machines including a pattern cam follower retracting arrangement employing a slidable control block formed with a pair of substantially identical cam tracks disposed laterally opposite each other in mirror image relation, one tracked by a retracting linkage and the other tracked by a stationary abutment pin thereby to minimize functional forces incident to operation of this cam selector mechanism.

4 Claims, 2 Drawing Figures

CAM SELECTOR MECHANISM FOR SEWING MACHINES

BACKGROUND OF THE INVENTION

A particularly cost effective and practical cam selector mechanism for effecting selection from a relatively small number of different pattern cams in a stack is disclosed in the U.S. patents of Urciola et al. U.S. Pat. No. 3,699,910, Oct. 24, 1972 and Graham et al. U.S. Pat. No. 3,753,411, Aug. 21, 1973. The present invention provides for an improvement in the above referenced pattern cam selector mechanisms which may be effected without materially increasing the complexity of construction but which significantly decreases the force required of a sewing machine operator to effect pattern cam selection. The above mentioned U.S. patents represent the closest prior art known to the inventors which is pertinent to the present invention.

SUMMARY OF THE INVENTION

It is an object of this invention to provide a sliding cam arrangement in a sewing machine in which the force necessary to effect an operation in response to the cam is minimized. This object of the invention is attained by providing two cam tracks, one the mirror image of the other, on a sliding control element and each having half the amplitude required to actuate the cam influenced operation. By providing a follower tracking one of the cam tracks and operatively connected to perform the ultimate cam influenced operation and a fixed abutment pin tracking the other of the cam tracks directly opposite the follower, the combination of operating and frictional forces in the system will be minimized.

DESCRIPTION OF THE DRAWINGS

With the above and additional objects and advantages in view, as will be described hereinbelow, this invention will be described with reference to the accompanying drawings of a preferred embodiment in which:

Referring to FIG. 1, the sewing machine and the zig zag mechanism therein may be identical with that illustrated in the U.S. Pat. No. 3,699,910, Oct. 24, 1972 of Urciola et al., which is incorporated herein by reference.

Figure 1:
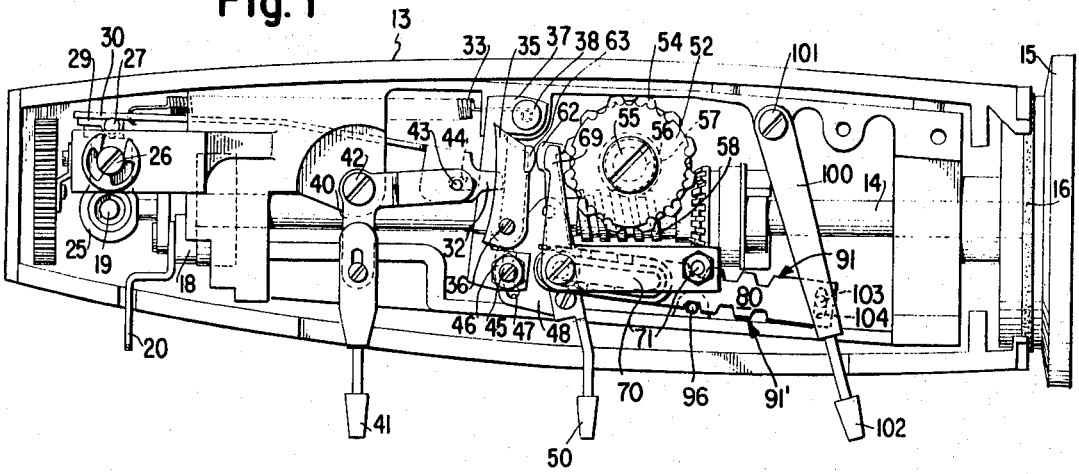
FIG. 1 is a top plan view of a sewing machine in which the top cover plate has been removed to expose the mechanism of this invention.

Indicated at 13 in FIG. 1, is the bracket arm portion of a sewing machine frame. A main shaft 14 is journalled in the sewing machine bracket arm and carries a balance wheel pulley 15 which is driven by a belt 16 from any suitable source of power. A crank mechanism 18 on the main shaft 14 is operatively connected to impart endwise reciprocatory movements to a needle carrying bar 19 and to impart oscillatory movement to a needle thread take-up 20.

The needle carrying bar 19 is journalled for endwise reciprocatory movement in a gate 25 which is pivotally supported in the sewing machine bracket arm on a stud 26. Secured by a set screw 28 in the gate is a connecting pin 27 by which a bracket 29 is pivoted to the needle bar gate. A needle jogging drive link 30 is secured to the bracket 29 by a fastening screw 31. A rounded nose 32 formed on the drive link 30 is maintained by a spring 33 against a radial shoulder 34 which is formed on an oscillating lever 35. The lever 35 is pivoted on a shoulder screw 36 to a needle positioning bracket 37 supported for turning movement on a pivot pin 38 secured in the sewing machine bracket arm.

To control the width of zig zag stitching a bell crank lever 40 with a handle 41 projecting exteriorly of the frame is fulcrummed on a shoulder screw 42 in the machine frame. The lever 40 carries a pin 43 passing through a slot 44 in the drive link 30 by which the rounded nose 32 on the drive link will be shifted along the radial shoulder 34 of the oscillating lever 35 to vary the width of zig zag stitching in proportion to the distance of the nose 32 from the screw 36 on which the oscillating lever is pivoted.

An eccentric pin 45 is threaded in the needle positioning bracket 37 and secured in selected position therein by a lock nut 46. The pin 45 passes through a slot 47 in a needle position adjusting lever 48. The lever 48 is fulcrummed on a stud 49 in the bracket arm 13 and is formed with a handle 50 projecting exteriorly of the machine frame. By setting the handle 50, the neutral position of needle vibration may be regulated to occur to the left, right or center of the field of zig zag stitching.

For controlling the pattern of zig zag stitching, three differently formed pattern cams 52, 53 and 54 are secured by a fastening screw 55 to a cam shaft 56 journalled in the machine frame. The cam shaft also carries a worm wheel 57 which meshes with a worm 58 carried on the sewing machine main shaft 14 so as to impart rotary movement to the stack of pattern cams at a fraction of the speed of rotation of the main shaft. A cam follower lever arm 59 is formed with a hub portion 60 (shown in FIG. 2) which is slidably pivoted on the stud 49. At the free extremity, the cam follower lever arm 59 is formed with a cam follower finger 61 adapted to track the periphery of any selected one of the pattern cams 52, 53 or 54. Opposite the cam follower finger, the cam follower lever arm is formed with an abutment finger 62 which occupies a position in engagement with a vertical elongate rib 63 formed on the oscillating lever 35.

The above described pattern cam influenced needle jogging mechanism is typical of a conventional arrangement well known in the art of zig zag sewing. This mechanism is well adapted to accommodate the pattern cam selecting mechanism of this invention although other known types of needle jogging mechanisms may also accommodate the present invention advantageously.

Figure 2:
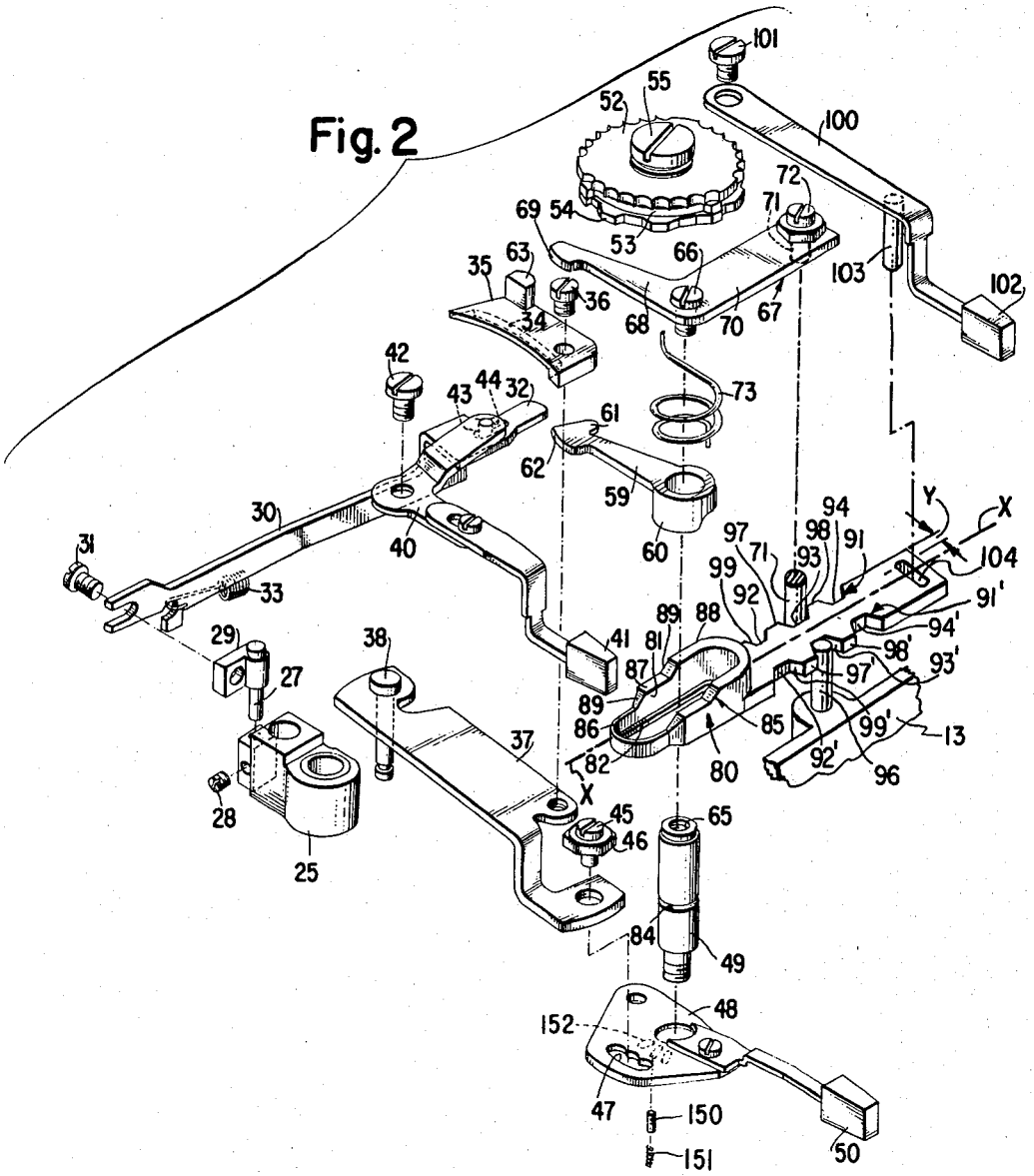
FIG. 2 is an exploded perspective view of portions of the mechanism shown in FIG. 1 illustrating the details of this invention.

As shown in FIG. 2, the stud 49 is formed at the top with a threaded axial hole 65 to accommodate a shouldered pivot screw 66 by which a throw-out lever 67 for the cam follower lever arm 59 is fulcrummed. One arm 68 of the throw-out lever 67 is formed with a finger 69 adapted to abut the vertical rib 63 of the oscillating lever 35. The other arm 70 of the throw-out lever 67 carries a follower pin 71 which may take the form of an eccentric pin threaded into the lever arm 70 and locked thereon by a lock nut 72. A light coil spring 73 is arranged between the throw-out lever 67 and the cam follower lever arm 59. The coil spring 73 encircles the stud 49 and engages the throw-out lever 67 with one extremity and the cam follower lever arm 59 with the other extremity. The coil spring 73 provides not only a light downward bias on the cam follower lever arm 59 tending to slide the lever arm 59 downwardly along the stud 49; but also provides a light turning movement urging the cam follower lever arm 59 away from the periphery of the pattern cams 52, 53 and 54. The force exerted by the spring 73 tending to turn the cam follower lever arm away from the cam stack is preferably only a small fraction of the force exerted by the spring 33 urging the needle jogging linkage toward the pattern cams.

As shown in FIG. 2, this invention provides for selection of any one of the pattern cams 52, 53 and 54 to be tracked by the finger 61 of the cam follower lever arm 59 by a simple mechanism employing an integral control block 80. The control block is formed with an elongate slot 81 adapted to embrace the stud 49 so that the control block is slidably pivoted on the stud 49. The control block 80 may also be formed with an internal lip 82 bordering the slot 81 for constraint within an annular groove 84 in the stud 49 so that the groove 84 provides an abutment vertically supporting the slide block 80. Along the slot 81 the control member is formed with a pattern cam selecting cam surface 85 comprising a series of steps 86, 87 and 88 differentiated by dimension in height and equal in number to the number of pattern cams 52, 53 and 54 in the pattern cam stack. A sloping ramp 89 is formed between each of the steps to ease the transition from one step to the other.

The control block 80 is formed with pattern cam follower retracting cam surfaces indicated generally at 91 and 91' preferably comprising a pair of substantially identically shaped cam tracks arranged laterally opposite each other in mirror image relation about a median line X-X lengthwise of the control block 80.

The cam track 91 is formed with a series of three cam notches 92, 93 and 94 with two intervening cam lobes 97 and 98 each projecting a uniform height Y outwardly from the notches. The number of notches are equal to the number of pattern cams in the stack, and are preferably evenly spaced by the intervening lobes at distances equal to the spacing between the steps 86, 87 and 88 of the pattern selector cam surface 85. Ramps 99 formed at the sides of the notches intervening the cam lobes are preferably of the same angle. Corresponding portions of the cam track 91' are denoted by the same reference characters as applied to the cam track 91 but using prime numbers.

As shown in FIG. 2, the follower pin 71 of the throw-out lever 67 is arranged in tracking relation with the cam track 91 while the cam track 91' is tracked by a stationary abutment pin 96 which is carried by the sewing machine frame 13 at a location along the cam track 91' which is in substantial mirror image relation with that tracked by the follower pin 71 along cam track 91.

For shifting the control block 80, an operator influenced lever 100 which is pivoted on a shouldered screw 101 in the machine frame is formed with a handle 102 located exteriorly of the sewing machine bracket arm 13. A connection pin 103 carried by the lever 100 is accommodated in a transverse slot 104 formed in the control block 80.

It will be appreciated that since both cam tracks 91 and 91' contribute to the motion of the throw-out lever 67; cam track 91 directly; and cam track 91' indirectly by way of lateral movement of the control block relatively to the stationary abutment pin 96, the height Y of the cam lobes 97, 98 and 97', 98' need only be one half of the height of the prior art cam lobes which acted individually to retract the pattern cam follower from the cam stack. Moreover, for any given spacing of the cam lobes, the angle of the ramps 99 and 99' need only be half of the ramp angle of prior art cam lobes for the same reason.

Since the characteristics of the materials, lubricants, etc. remain substantially unchanged as between the prior art control block cam construction and those of this invention, the friction forces which will be developed as a result of the operation of the cam surfaces will depend upon the normal forces developed in the system. Understandably, with double the ramp 99 angle required in the prior art cam construction, higher normal force is generated between the cam and the follower approaching twice that of the normal force generated between the cam 91 and the follower 71 in the present invention, but since there are two cam tracks 91, 91' involved in the present invention the friction forces between the cam and the followers is substantially the same in both cases. With the prior art construction, however, the frictional forces generated as a result of the normal force reaction being accommodated at the stud 49 in the slot 81 of the control block and at the connection between the control block and a manual operating lever must be added to the total force which the operator must overcome. Such reaction forces are absent in the present invention and, therefore, the total of the forces which an operator experiences in selecting a pattern cam are significantly and noticably reduced.

Having set forth the nature of this invention, what is claimed herein is:

1. A pattern cam selector mechanism for a needle jogging mechanism in the frame of a zig zag sewing machine employing a control block slidably supported for movement relatively to said sewing machine frame, a manually influenced actuating member in said sewing machine operatively connected to said control block, cam surfaces formed on said control block, and pattern cam selector linkage means responsive to said cam surfaces, the improvement in which said cam surfaces include a pair of substantially identically shaped cam tracks arranged laterally opposite each other in mirror image relation on said control block, said pattern cam selector linkage means arranged in tracking relation with one of said cam tracks, and an abutment pin carried on said sewing machine frame and arranged in tracking relation with the other of said cam tracks at a point along said cam track which is in substantial mirror image relation with that tracked by said pattern cam selector linkage means.

2. A pattern cam selection mechanism for a needle jogging mechanism in the frame of a zig zag sewing machine having a pattern cam follower interposed between the needle jogging mechanism and any one pattern cam of a stack of pattern cams, operator influenced pattern cam selecting means for shifting said pattern cam follower between tracking relation with adjacent pattern cams in said stack, and a control block slidably supported for movement relatively to said sewing machine frame for retracting said pattern cam follower from tracking relation with pattern cams in said stack during operation of said pattern cam selecting means, a manually influenced actuating member in said sewing machine operatively connected to said control block, retracting linkage including a retracting cam follower operatively associated with said pattern cam follower, a pair of substantially identically shaped retracting cam tracks arranged laterally opposite each other in mirror image relation on said control block, each of said cam tracks having cam surfaces effective to impart one half of the necessary retracting movement to said pattern cam follower, said retracting cam follower arranged in tracking relation with one of said pair of retracting cam tracks, and an abutment pin carried by said sewing machine frame and arranged in tracking relation with the other of said pair of retracting cam tracks at a point along said cam track which is in substantial mirror image relation with that tracked by said retracting cam follower.

3. A pattern cam selection mechanism as set forth in claim 2 in which said operator influenced pattern cam selecting means includes pattern selecting cam surfaces carried on said control block for operation by said operator influenced actuating member.

4. A pattern cam selector mechanism as set forth in claim 3 in which said pattern cam follower is slidably arranged on a stud carried in said sewing machine frame, in which said control block is formed with a guide slot slidably imbracing said stud, in which said abutment pin is arranged substantially parallel to said stud to define with said stud a translatory path of sliding movement for said control block, in which said manually influenced actuating member comprises a lever pivotally supported in said sewing machine frame and in which the operative connection between said actuating member and said control block consists of a pin carried by said lever arranged in a slot formed in said control block and extending transversely of said translatory path of sliding movement of said control block.

* * * * *